US005896742A

United States Patent [19]

Black et al.

[11] Patent Number: 5,896,742

[45] Date of Patent: Apr. 27, 1999

[54] TAPERED CROSS-FIRE TUBE FOR GAS TURBINE COMBUSTORS

[75] Inventors: Stephen Hugh Black, Duanesburg; John Luigi Battaglioli, Glenville; William Theodore Bechtel, II, Scotia, all of N.Y.

[73] Assignee: General Electric Co., Schenectady, N.Y.

[21] Appl. No.: 08/821,376

[22] Filed: Mar. 20, 1997

[51] Int. Cl.[6] ..... F23R 3/48

[52] U.S. Cl. ..... 60/39.37; 60/39.32

[58] Field of Search ..... 60/39.37, 39.32, 60/39.31, 39.06

[56] References Cited

U.S. PATENT DOCUMENTS

| | | | |
|---|---|---|---|
| 2,611,243 | 9/1952 | Huyton | 60/39.37 |
| 2,722,803 | 11/1955 | Travers | 60/39.37 |
| 2,729,938 | 1/1956 | McDowall et al. . | |
| 3,369,366 | 2/1968 | Howald | 60/39.32 |
| 3,701,552 | 10/1972 | Cowan . | |
| 3,991,560 | 11/1976 | DeCorso et al. | 60/39.32 |
| 4,249,372 | 2/1981 | White | 60/39.37 |
| 5,154,049 | 10/1992 | Ford et al. | 60/39.37 |
| 5,265,413 | 11/1993 | Cannon et al. | 60/39.37 |
| 5,361,577 | 11/1994 | Cromer | 60/39.37 |

OTHER PUBLICATIONS

"Gas Turbine Design Philosophy", D.E. Brandt, GE Turbine Reference Library, pp. 1–18, 1991.

*Primary Examiner*—Timothy S. Thorpe
*Assistant Examiner*—Ted Kim
*Attorney, Agent, or Firm*—Nixon & Vanderhye

[57] ABSTRACT

A cross-fire tube for connecting adjacent combustors in a gas turbine includes a hollow tubular body having couplings at opposite free ends thereof, the hollow tubular body having a substantially circular cross-sectional shape with a maximum diameter region about mid-way between the couplings, tapering in opposite directions to smaller diameters at the free ends. A plurality of purge holes are located in the maximum diameter region.

11 Claims, 2 Drawing Sheets

TAPERED CROSS-FIRE TUBE FOR GAS TURBINE COMBUSTORS

TECHNICAL FIELD

This invention relates to gas turbine combustors and more specifically, to a uniquely shaped cross-fire tube which extends between adjacent combustion chambers in an arrangement where plural combustion chambers, or "cans" the are arranged in a circle about the axial centerline of the gas turbine.

BACKGROUND PRIOR ART

Gas turbines manufactured by the assignee are a so-called "can annular" design where 10, 14 or 18 combustion chambers or cans are arranged in a circle about the axial centerline of the gas turbine. The combustion cans are isolated from one another, except for the cross-fire tube connections between adjacent cans. The name of these tubes implies their function, i.e., the crossing of flame from one can to the next during ignition. The current gas turbine design incorporates two cans with ignition devices (spark plugs), while the other cans are lighted by the flame passing through the cross-fire tubes from the adjoining lighted can. Further, in the current Dry Low NOx gas turbine manufactured by the assignee, the cross-fire tubes must also pass flame from the lighted to the unlighted premixing regions of the combustion cans during transfer from a premixed mode to a lean-lean mode. In the premixed mode, the region of the combustor connected by cross-fire tubes has no flame and is used for premixing the fuel and air, while in the lean-lean mode this same region has flame. The specific function of the cross-fire tubes, whether during ignition or re-light of the premixing zone, is simply to pass flame from adjoining combustion cans. This process generally occurs in a matter of seconds. At all other times in the gas turbine operation, the cross-fire tubes perform no specific function.

When the cross-fire tubes are not in use, they must resist the unwanted passage of either hot gases from combustion or unburned fuel in the premixing zone from adjoining cans. This continuous cross-flow is due to chamber-to-chamber pressure differences resulting from small geometrical differences among the combustion hardware; from unequal distribution of fuel to the individual chambers; and from area variations in the gas turbine first stage nozzle passages. Continuous cross-flow of hot gas can permanently damage the combustion liner or cross-fire tube due to heating of the metal to its melting point. Some cooling is provided to the liner and cross-fire tube to protect against this cross-flow, but it is not robust enough for protection at high levels of cross-flow. Passage of unburned fuel from one can to the next produces a situation in the receiving can where the additional fuel produces streaks of fuel through the combustor. Hot streaks produced by the burning of this additional fuel may cause local over-heating of combustion components, or a situation where in the premixed mode, flame travels upstream with the fuel streak and produces a flashback event. A flashback event is a premature and unwanted re-light of the premixing zone during premixed mode operation, which produces an order of magnitude increase in NOx emissions due to the momentary transfer out of the premixed mode.

Specific to operating a Dry Low NOx combustor in the premixed mode with oil fuel, is the requirement that oil not be ingested into the cross-fire tubes. Unless protection is provided by design, there is a high probability this event will occur since the ends of the cross-fire tubes are located adjacent to the fuel nozzles to allow for ignition cross-firing. Given sufficient amount of time, No. 2 fuel oil, which is commonly used in gas turbine operation, will auto-ignite at temperatures above 400 to 500 degrees F. The baseline operating temperature is above 600 degrees F. and if oil does indeed settle into the cross-fires tube, it will remain there until either auto-igniting or burning by the cross-flow of hot gases.

The cross-fire tube configuration prior to this invention was designed to address the first stated problem, i.e., cross-flow of hot gas and/or unburned fuel. However, computer fluid dynamic (CFD) modeling of the air purge flow shows ineffective blockage of cross-flow through the tube. In the conventional practice, purge flow is admitted into the tube at each end with four equally spaced, opposed holes drilled into the wall of the tube. Air jets produced by the purge flow entering the tube coalesce at the tube axial centerline, such that the purge air is directed in both longitudinal directions. It has been determined that the major resistance to cross-flow occurs along the tube centerline and decreases toward the tube wall. With this pattern of purge air flow, hot gases or unburned fuel can bypass the air purge jets along the tube wall through the regions out of line with the air jets themselves. Thus, a flow condition can exist where even though cooling flow exits both ends of the tube, there is a continuous flow of gases from one chamber to the next, depending on chamber-to-chamber pressure differences.

DISCLOSURE OF THE INVENTION

The principal objectives of this invention are as follows:

1. To provide improved resistance to continuous cross-flow of hot combustion gases or unburned fuel between combustion chambers spanned by the cross-fire tube.
2. To eliminate the ingestion of fuel oil into the cross-fire tube passage.
3. To provide a means of passing combustion flame from one chamber to the other spanned by the cross-fire tube during machine ignition.
4. To provide a means of passing combustion flame from one chamber to the other spanned by the cross-fire tube during a normal machine transfer from a premixed to lean-lean operating mode in the GE Dry Low NOx 1 combustion system.
5. To provide a means of passing combustion flame from one chamber to the other spanned by the cross-fire tube in the event of auto-ignition or combustion flame flashback into the combustor premixing zone of the GE Dry Low NOx 1 combustion system.

The unique features of the invention relate to the introduction of purge air at the tube mid-section, and the re-design of the tube to include a narrowing taper from the mid-section of the tube to the opposite ends of the tube. The narrowing taper, particularly in the areas nearer the outer ends of the tubes, causes the purge air flow to accelerate and be forced against the tube walls such that the purge air fills the entire cross-section at the opposite ends of the tube. Thus, uniform, high velocity flow is created at the tube ends which effectively eliminates oil ingestion and inhibits chamber to chamber cross-flow.

In its broader aspects, therefore, the present invention relates to a cross-fire tube for connecting adjacent combustors in a gas turbine, the cross-fire tube comprising a hollow tubular body having opposite free ends, said hollow tubular body having a substantially circular cross-sectional shape with a maximum diameter in a mid-section of the tube, tapering in opposite directions to smaller diameters at the free ends.

In another aspect, the invention relates to a cross-fire tube for connecting adjacent combustors in a gas turbine, the cross-fire tube comprising a hollow tubular body having opposite free ends thereof, the hollow tubular body having a substantially circular cross-sectional shape with a maximum diameter region in a mid-section of the tubular body, and further comprising a plurality of purge holes located in the mid-section.

Other objects and advantages of the present invention will become apparent from the detailed description which follows.

BEST MODE FOR CARRYING OUT THE INVENTION

Figure 1:
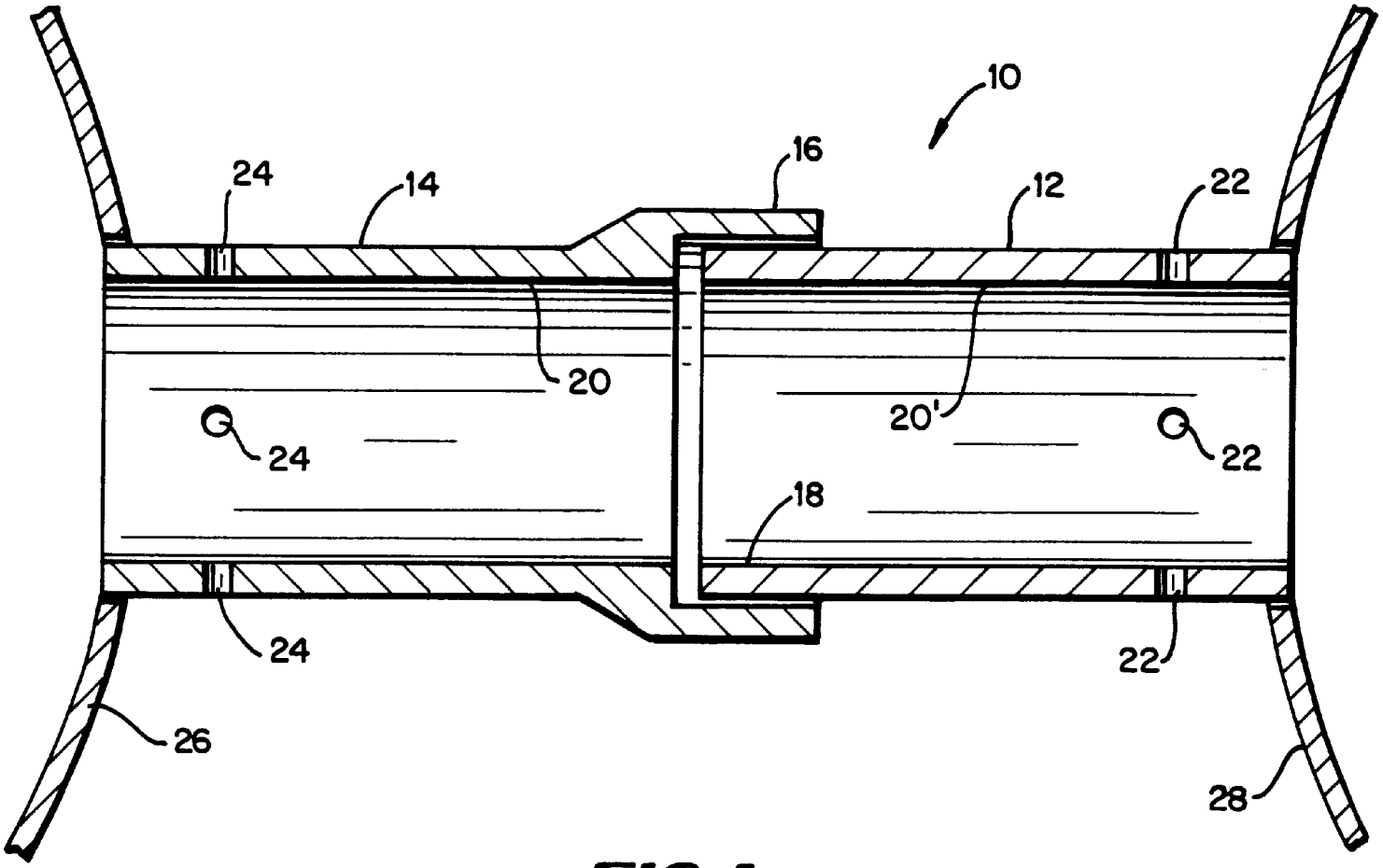
FIG. 1 (Prior Art)
FIG. 1 is a cross section taken through a prior art cross-fire tube design.

With reference first to FIG. 1, a cross-fire tube 10 in accordance with conventional design includes a substantially cylindrical male section 12 and a substantially cylindrical female section 14, the female section having an enlarged end 16 adapted to receive the free end 18 of the male section 12 in telescoping relationship, and secured there by any suitable means. The interior of the cross-fire tube is characterized by substantial uniform diameter interior wall 20, 20'. A plurality of air purge holes 22, 24 are drilled in each of the male section 12 and female section 14, respectively, in areas adjacent respective combustion can liners 26, 28. The problems associated with this conventional cross-fire tube design are described above and need not be repeated here.

Figure 2:
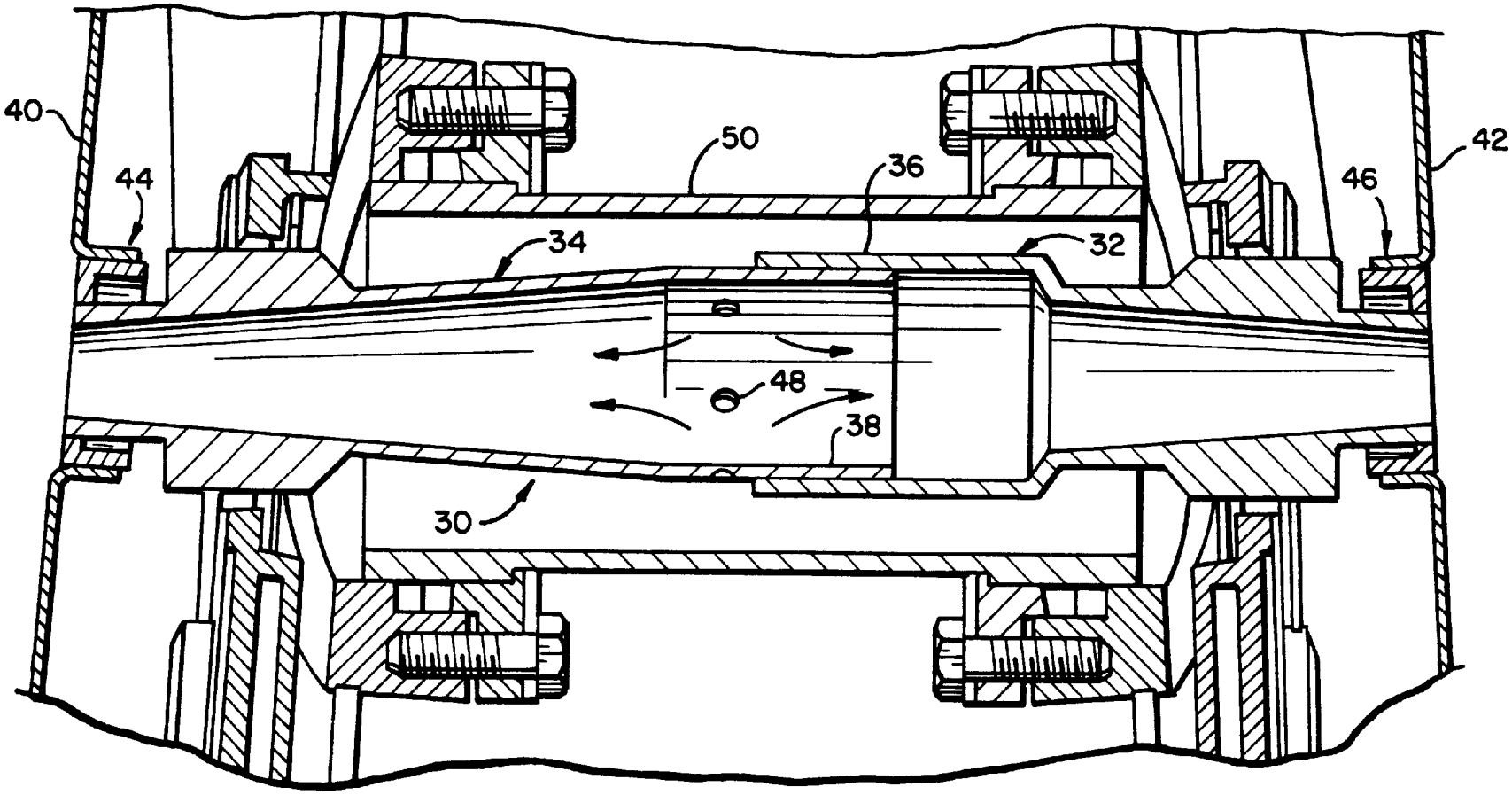
FIG. 2 is a side elevation, partly in section, of a cross-fire tube in accordance with this invention, mounted between adjacent combustion liners.

Turning now to FIG. 2, the cross-fire tube in accordance with an exemplary embodiment of this invention includes a tubular body 30 having a female section 32 and a male section 34. The female section 32 has an enlarged diameter portion 36 at one end which is adapted to receive a corresponding end 38 of the male section 34 in a mid-section of the tubular body. In the area of the telescoping joint, where the tube diameter is greatest, the inside diameter of the male section is about two inches. On either side of the coupling area in the tube mid-section, the diameters of the cross-fire tube sections taper uniformly to smaller one-inch diameters at the opposite ends, which are connected to adjacent combustor cans 40, 42 via couplings 44, 46, respectively (the couplings per se form no part of this invention). The overall length of the tube is about 15 inches. The geometry at the male/female interface, i.e., the diameter changes and slightly asymmetrical mid-section, do not significantly affect the performance of the tube for reasons given below. The degree and uniformity of taper are the more significant factors, but it will be appreciated that the specific dimensions here are exemplary, and not necessarily required.

The male section 34 of the cross-fire tube assembly has a number of equally spaced air purge holes (six in the exemplary embodiment) 48 of a specified diameter (0.29 inch) drilled through the tube wall near the longitudinal mid-point of the tube, i.e., adjacent the free edge of the female section 36. The diameter of the purge holes is dependent on the particular gas turbine application. The important dimensional characteristics of the tapered cross-fire tube design are thus the location of the air purge holes in the mid-section of the tube, the diameter of the air purge holes, and the degree of taper from the mid-section to the tube ends.

As illustrated, the cross-fire tube assembly is surrounded by a pressure containing vessel 50, which is a cylindrical tube external to the compressor discharge casing. In other applications, the cross-fire tubes may be contained within the compressor discharge casing. Air is transported to the cross-fire tube air purge holes 48 from within the compressor discharge casing 50 or the annulus developed by the combustion flow sleeve and liner. Upon flowing through the air purge holes 48, the air jets which are formed coalesce and turn in both longitudinal directions (see the flow arrows in FIG. 2) similar to the flow characteristic of the prior cross-fire tube design. However, in this invention, the tapered half sections 32, 34 force the purge air flow to accelerate and migrate towards the tube walls as it is forced outward to both ends of the tube. At the ends of the tube, the air purge flow becomes uniform in distribution and of a higher velocity that what would exist with a constant diameter (cylindrical) tube. This flow characteristic generates the air momentum required to keep oil from entering the tube. Additionally, this characteristic is more effective than the previous tube design in blocking the continuous cross-flow of hot gas and unburned fuel. Because the air flow does not fully attach to the tube walls until the flow reaches approximately the last half of the flow path (in both directions), the structural discontinuities in the mid-section are not deleterious to the operation of the tube.

To summarize, the unique features of this invention are (1) admitting purge air at a mid-section of the tube, and (2) tapering the internal cross-section from approximately the mid-section of the tube outwardly in opposite directions so as to be narrow at the ends of the tube which join to the adjacent combustion liners. The invention thus provides a new technique for purging the cross-fire tube with air in order to more effectively inhibit the cross-flow of hot combustion gases or unburned fuel from one combustion chamber to the other spanned by the cross-fire tube, and to eliminate the ingestion of oil fuel into the cross-fire tube during premixed oil operation in the GE Dry Low NOx 1 combustor.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A cross-fire tube for connecting adjacent combustors in a gas turbine, the cross-fire tube comprising a hollow tubular body having opposite free ends, said hollow tubular body having a substantially circular cross-sectional shape with a mid-section of the tube having one or more diameters, and further comprising a plurality of purge air holes located in said mid-section, and tapering continuously from said mid-section in opposite directions to opposite free ends which have diameters smaller than all of said one or more diameters in said mid-section such that when purge air flows through said plurality of purge holes, the purge air is accelerated as it flows toward said opposite free ends to thereby provide in use, uniform distribution of the purge air to obstruct flow of hot combustion gas and unburned fuel between adjacent combustion chambers.

2. The cross-fire tube of claim 1 wherein said plurality of purge air holes comprise six holes equally spaced about said mid-section.

3. The cross-fire tube of claim 1 wherein said hollow tubular body is formed in two sections joined at said mid-section.

4. The cross-fire tube of claim 3 wherein said two sections include a male section and a female section, said male section telescopingly received within said female section at said mid-section.

5. The cross-fire tube of claim 4 wherein said air purge holes are provided in said male section, axially adjacent an edge of said female section.

6. The cross-fire tube of claim 4 wherein said maximum diameter is about two inches.

7. The cross-fire tube of claim 6 wherein minimum diameters at opposite ends of said tubular body are about one inch.

8. The cross-fire tube of claim 7 wherein each purge hole has a diameter of about 0.29 inch.

9. The cross-fire tube of claim 4 wherein said minimum diameters at opposite ends of said tubular body are about one inch.

10. The cross-fire tube of claim 9 wherein each purge hole has a diameter of about 0.29 inch.

11. The cross-fire tube of claim 8 wherein said tube has a length of about 15 inches.

* * * * *